US006771227B2

(12) United States Patent
Tsai et al.

(10) Patent No.: US 6,771,227 B2
(45) Date of Patent: Aug. 3, 2004

(54) COLLINEAR ANTENNA STRUCTURE

(75) Inventors: Churng-Jou Tsai, Tainan Hsien (TW); Ming-Hsiun Chong, Taipei (TW)

(73) Assignee: Antenniques Corporation, Tainan Hsien (TW)

( * ) Notice: Subject to any disclaimer, the term of this patent is extended or adjusted under 35 U.S.C. 154(b) by 0 days.

(21) Appl. No.: 10/247,958

(22) Filed: Sep. 19, 2002

(65) Prior Publication Data

US 2004/0056817 A1 Mar. 25, 2004

(51) Int. Cl.[7] ..... H01Q 9/16
(52) U.S. Cl. ..... 343/801; 343/792; 343/813
(58) Field of Search ..... 343/801, 793, 343/796, 791, 792, 798, 800, 802, 803, 804, 813; H01Q 9/16

(56) References Cited

U.S. PATENT DOCUMENTS 4,872,021 A * 10/1989 Tabakov et al. ..... 343/801
5,089,829 A * 2/1992 Haruyama et al. ..... 343/852
6,552,692 B1 * 4/2003 Zeilinger et al. ..... 343/792

* cited by examiner

*Primary Examiner*—Hoanganh Le

(57) ABSTRACT

The present invention relates to a collinear antenna structure. The structure comprises a dipole antenna, a coil, and a set of stacked radiator, wherein the length of the dipole antenna is ½λ, the ground end and the signal end of the dipole antenna are connected to a coaxial cable, the length of the cable line is less than ¼λ, one end of the cable line is connected in series to the top of the signal end, wherein the stacked radiator comprising at least two parallel radiators in series, the length of each radiator is ½λ, the distance between the two radiators is about 1.0 to 4.0 mm, one of the stacked radiator is axially connected in series to the other end of the coil, thus forming the structure of the antenna. This invention provides a collinear antenna structure, the antenna uses the coil to axially connect the signal end of the dipole antenna and the stacked radiator, and let the electromagnetic radiation wave emitted from the signal end of the dipole antenna and the electromagnetic radiation wave emitted from the stacked radiator to propagate toward the same direction thus promoting the radiation gain profit effect. Through a combination of at least two parallel radiators in series and the associated coil, the entire length of the antenna could be effectively reduced, it is also intended that this invention is suitable for the usage of desk electric communication equipment.

2 Claims, 7 Drawing Sheets

VSWR

Return Loss

H-Plan

E-Plane

COLLINEAR ANTENNA STRUCTURE

FIELD OF THE INVENTION

The present invention relates to a collinear antenna structure, and more specifically to a stacked radiator collinear antenna structure.

BACKGROUND OF THE INVENTION

The traditional basic structure of a dipole antenna is one signal end matched with one ground end and the two ends are connected to a coaxial cable as shown in FIG. 1. The theoretical averaged radiation gain profit of this basic structure is about 2.14 dBi. However, under this basic structure, the normally used method for promoting the radiation gain profit is to connect more than one dipole antenna in collinear to obtain higher radiation purpose. But when the antenna is positioned in collinear, the entire length of the antenna structure would be too long. For example, the normal collinear array antenna under the condition of using 2.4 to 2.5 GHz channel band, in order to obtain the ideal 6.0 to 7.0 dBi radiation gain profit value, the ideal length of the collinear antenna would be about 30.0 to 40.0 cm. It is evident that the length of the antenna is too long to suit for the usage of desk space.

The traditional collinear antenna structure as shown in FIG. 2 is the Franklin antenna, FIG. 3 is the series-fed transposed coaxial collinear antenna, and FIG. 4 is the series-fed symmetrical coaxial collinear antenna. Basically, the antenna structures mentioned above are all connected in collinear. Taking FIG. 4, series-fed symmetrical coaxial collinear antenna as an example, in order to obtain a 6.0 dBi radiation gain profit value, the length of the collinear antenna structure is about 3.0 λ, when using the 2.45 GHz channel band, the wavelength A is 122 mm, so the entire length of the antenna is about 36.6 cm, the length is not suitable for desk space usage and only suitable for outdoor usage only. Taking FIG. 2 and FIG. 3 as another examples, when using the 2.45 GHz channel band, in order to obtain 6.0 dBi radiation gain profit value, the length of the antenna structure would be 2.5 to 3.0 λ, and the entire length of the antenna is approximately equal to 30.0 to 38.0 cm, which is also too long to suit for desk space usage, and only suitable for outside use only.

In order to solve the problem mentioned above, the present invention provides a collinear antenna structure for effectively shortening the length of the antenna and suits for the need of desk electric communication equipment.

It is a purpose of this invention to provide a collinear antenna structure, the antenna uses the coil to axially connect the signal end of the dipole antenna and the stacked radiator, and let the electromagnetic radiation wave emitted from the signal end of the dipole antenna and the electromagnetic radiation wave emitted from the stacked radiator to propagate toward the same direction thus promoting the radiation gain profit effect.

Through a combination of at least two parallel radiators positioned in series and the associated coil, the entire length of the antenna could be effectively reduced, it is intended that this invention is suitable for the use of desk electric communication equipment.

SUMMARY OF THE INVENTION

The above problems and others are at least partially solved and the above purposes and others are realized in a collinear antenna structure shown as follow:

The present invention relates to a collinear antenna structure. The structure comprises a dipole antenna, a coil, and a set of stacked radiator, wherein the length of the dipole antenna is ½λ, the ground end and the signal end of the dipole antenna are connected to a coaxial cable line, the length of the cable line is less than ¼λ, one end of the cable line is connected in series with the top of the signal end, wherein the stacked radiator comprising at least two parallel radiators in series, the length of each radiator is ½λ, the distance between radiators is about 1.0 to 4.0 mm, one of the stacked radiator is connected in series with one end of the coil, thus forming the structure of the antenna. This invention provides a collinear antenna structure, the antenna uses the coil to axially connect the signal end of the dipole antenna and the stacked radiator, and let the electromagnetic radiation wave emitted from the signal end of the dipole antenna and the electromagnetic radiation wave emitted from the stacked radiator to propagate toward the same direction thus promoting the radiation gain profit effect. Through a combination of at least two parallel radiators in series and the associated coil, the entire length of the antenna could be effectively reduced, it is intended that this invention is suitable for the use of desk electric communication equipment.

BRIEF DESCRIPTION OF THE DRAWING

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE INVENTION

Figure 5:
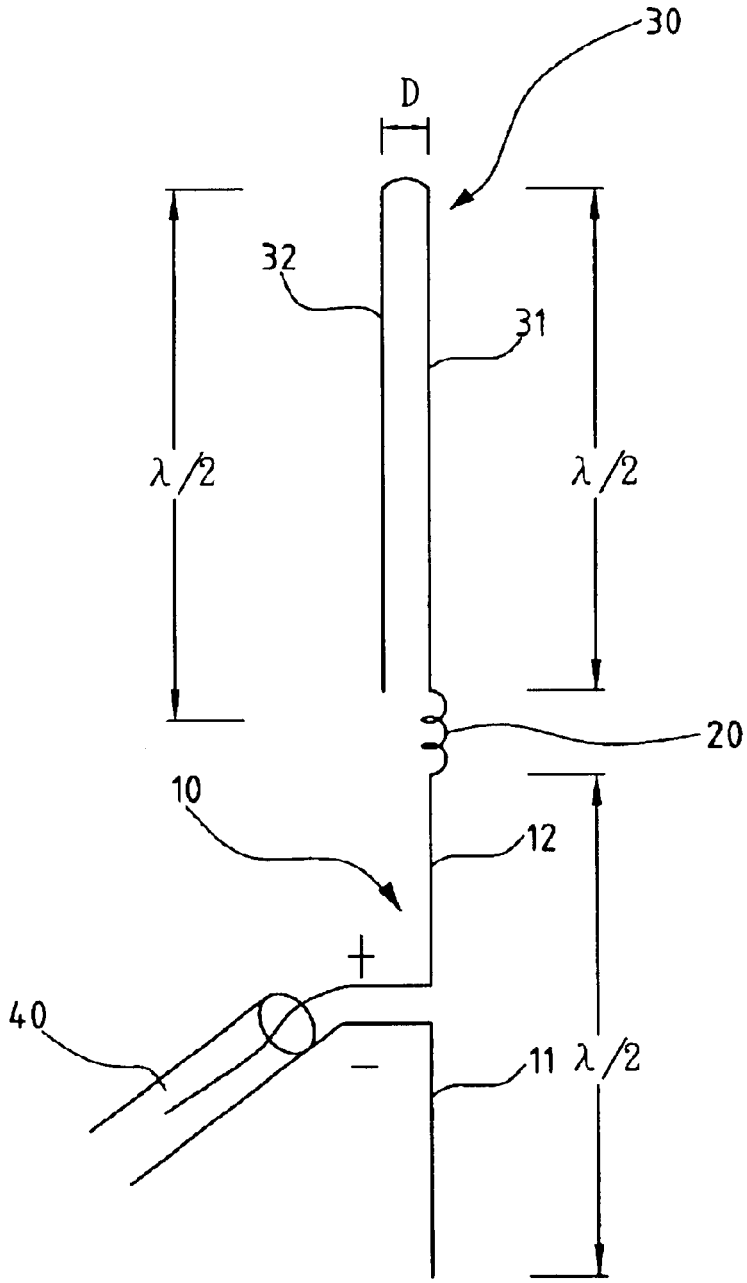
FIG. 5 Depicts a diagram showing the antenna structure of the preferred embodiment of this invention.

FIG. 5 depicts a structure of the collinear antenna in this invention which comprising a dipole antenna 10, a coil 20 and a set of stacked radiator 30, wherein the length of the dipole antenna 10 is ½λ, the ground end 111 and the signal end 12 are connected to a coaxial cable line 40, wherein the length of the coil 20 is less than ¼λ, one end of the coil is axially connected to the top of the signal end 12.

The stack radiator 30 comprising at least two parallel collinear radiators 31, 32, the length of the radiators 31, 32 is ½λ, the distance between the radiators is approximate 1.0 to 4.0 mm, in this embodiment, because the two radiators 31, 32 both have the same radiation effect, the coil 20 is axially connected to the signal end 12 of the dipole antenna 10 and the radiator 31 of the stack radiator 30, thus making the electromagnetic wave emitted from the signal end 12 of the dipole antenna 10 and the electromagnetic wave emitted from the two radiators 31, 32 to propagate in the same direction hence promoting the gain effect of the radiation.

On the other hand, the two radiators 31, 32 are collinearly positioned in parallel which would indeed reduce the entire length of the antenna.

Figure 1:
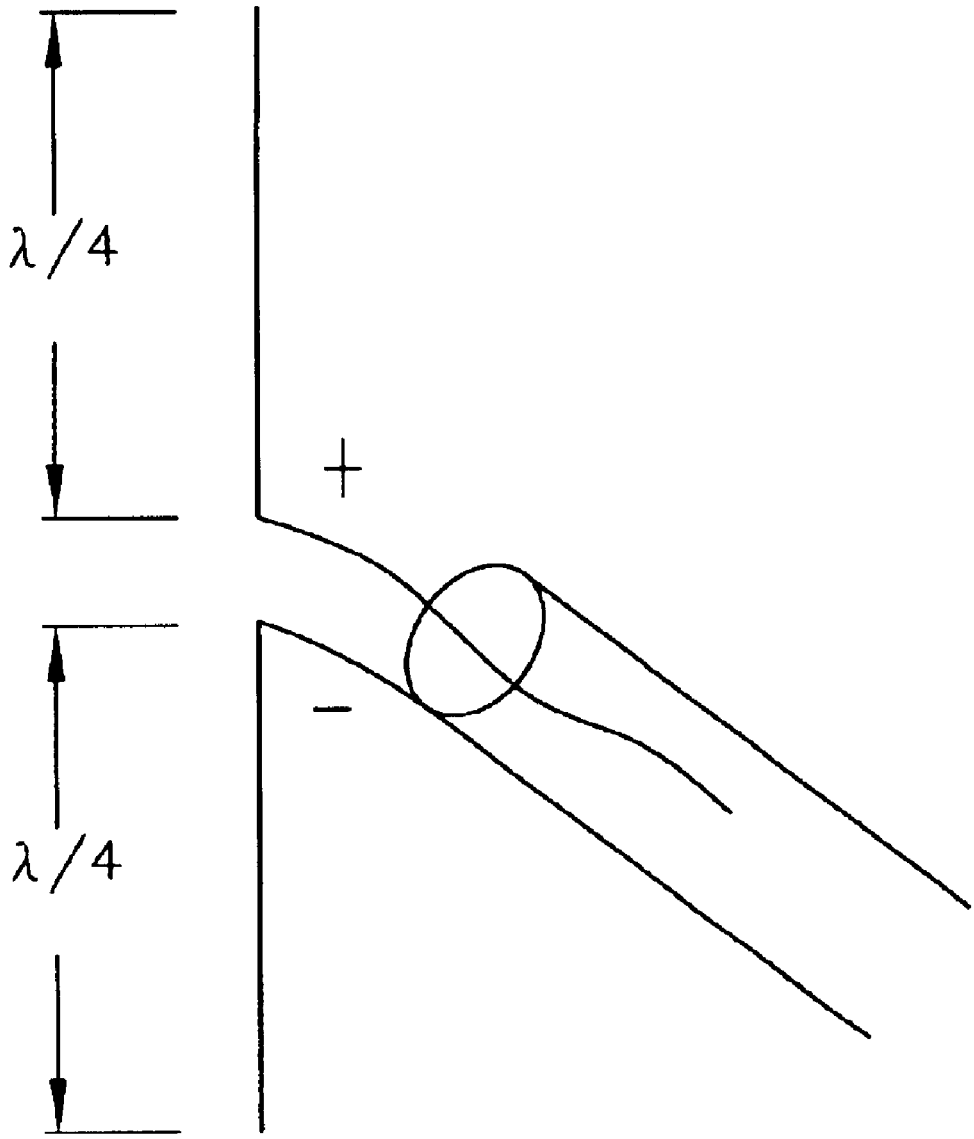
FIG. 1 (PRIOR ART)
FIG. 1 Depicts a diagram showing the structure of the traditional dipole antenna.
Figure 2:
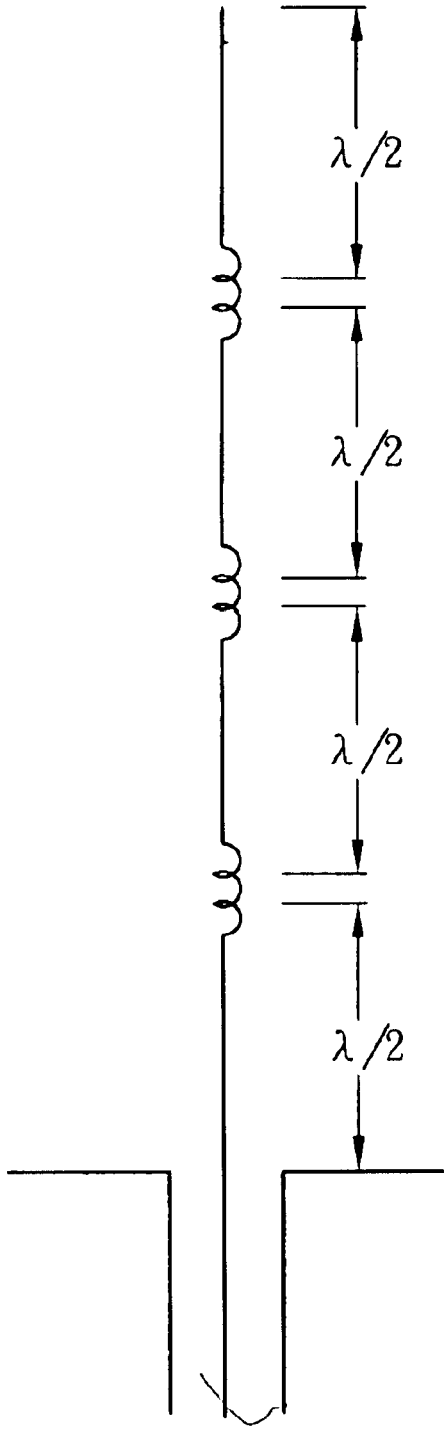
FIG. 2 (PRIOR ART)
FIG. 2 Depicts a diagram showing the structure of the collinear Franklin antenna.
Figure 3:
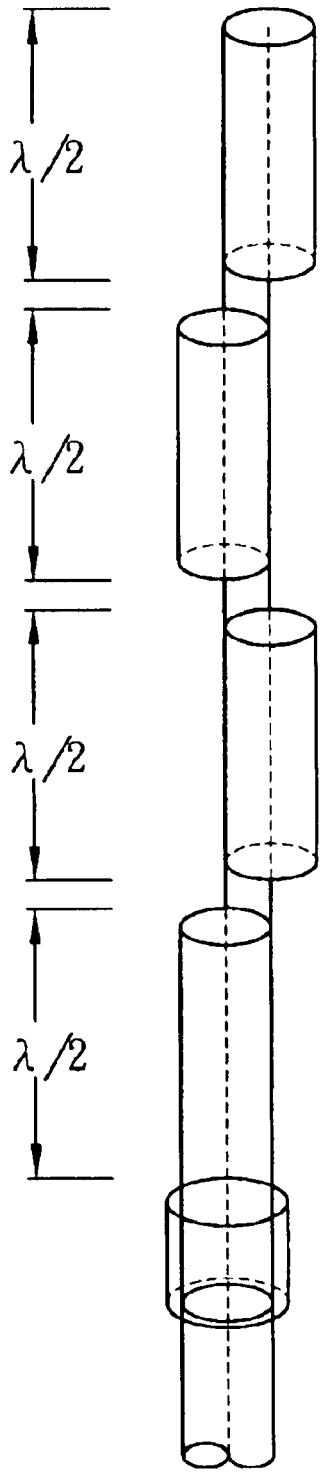
FIG. 3 (PRIOR ART)
FIG. 3 Depicts a diagram showing the structure of a series-fed transposed coaxial collinear antenna.
Figure 4:
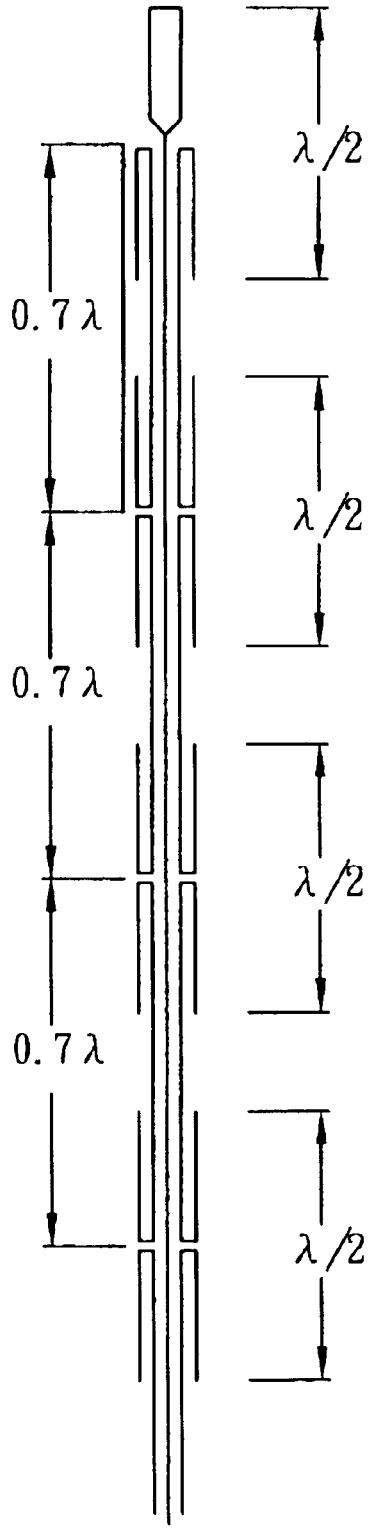
FIG. 4 (PRIOR ART)
FIG. 4 Depicts a diagram showing the structure of a series-fed symmetrical coaxial collinear antenna.

Referring to FIG. 5, the length of the dipole antenna is ½λ, the length of the coil is less than ¼λ, the length of the stacked radiator is ½λ, thus the entire length would be ⅝λ; Under the condition of using 2.45 GHz channel band where λ is 122 mm, as a whole, the entire length would be 15.25 cm, taking also the additional antenna covering body and the fixing device (not shown) into account, the length of this device would be about 19.0 cm, and the radiation gain value would be 6.5 dBi, as comparing to the traditional antenna (see FIG. 2, FIG. 3, and FIG. 4) length of about 30.0 to 40.0 cm, the present invention is truly more compact than the previous ones.

Figure 6:
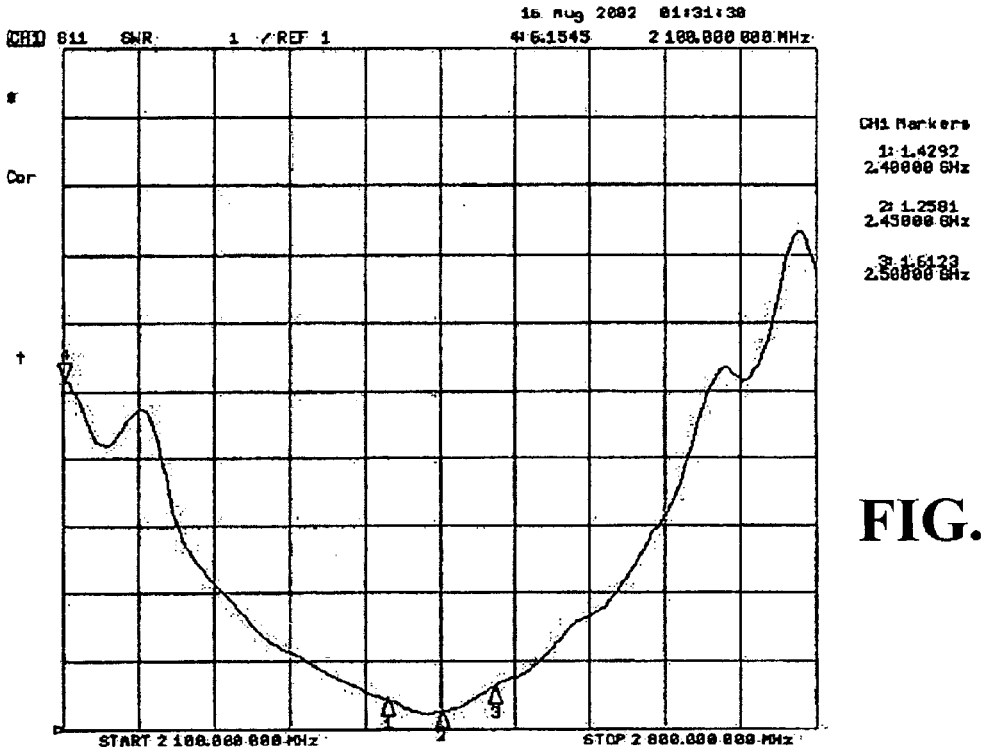
FIG. 6 Depicts the voltage standing wave ratio (VSWR) diagram of the preferred embodiment of this invention.
Figure 7:
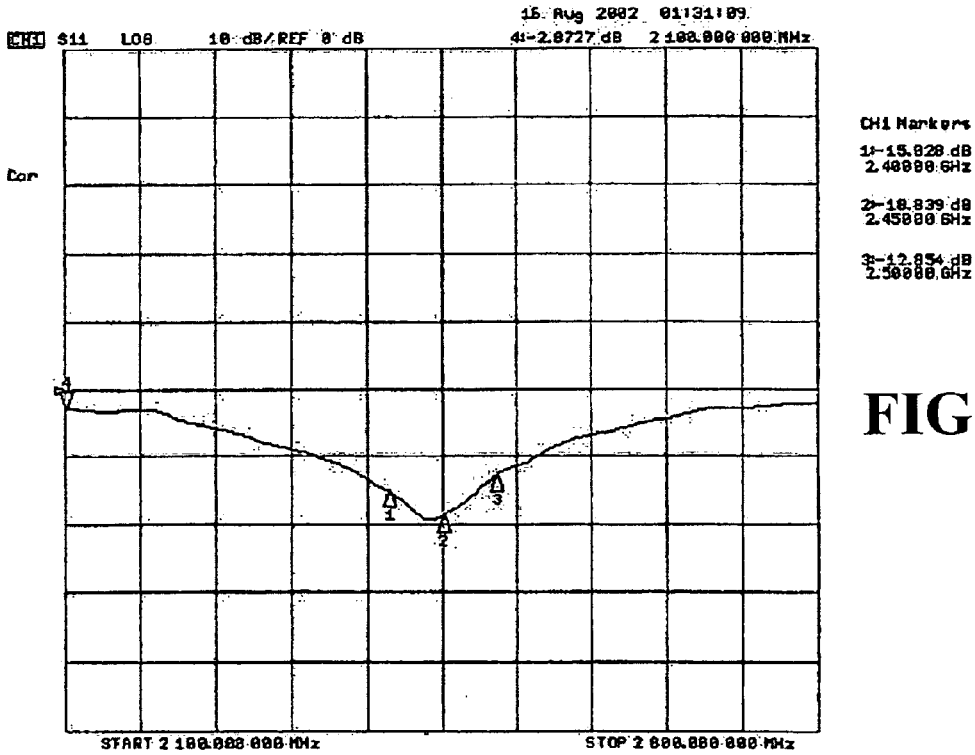
FIG. 7 Depicts the reflection return loss diagram of the preferred embodiment of this invention.
Figure 8:
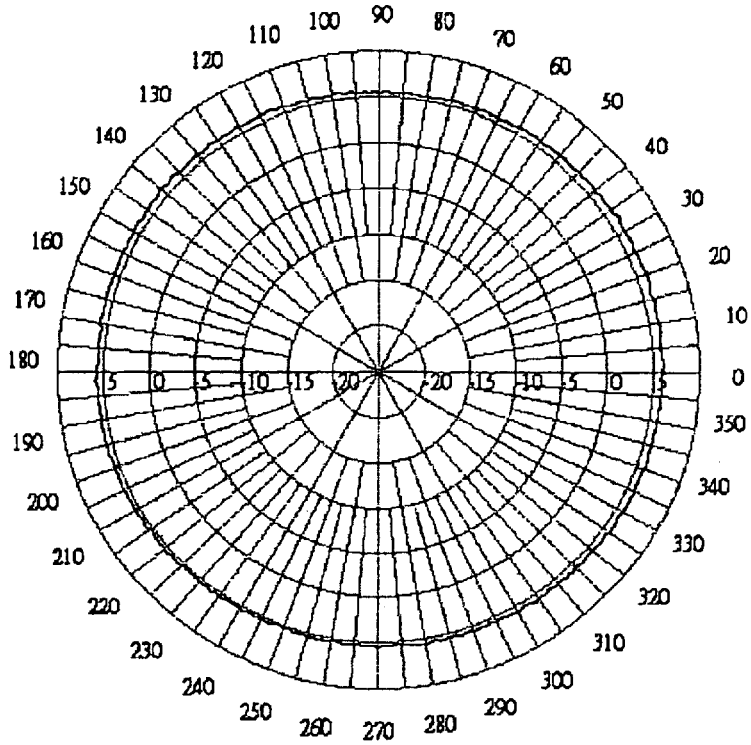
FIG. 8 Depicts the H-plane radiation field diagram of the preferred embodiment of this invention.
Figure 9:
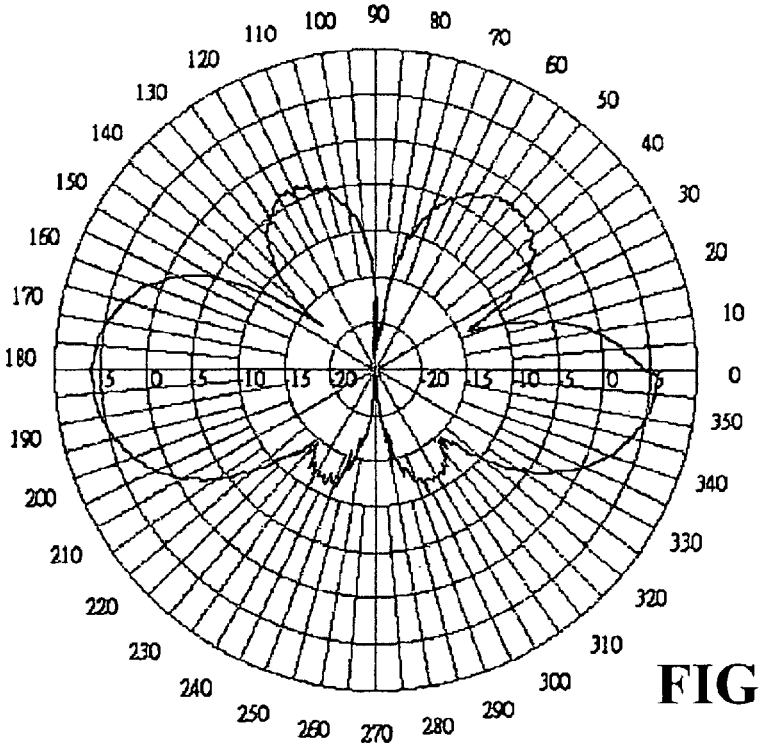
FIG. 9 Depicts the E-plane radiation field diagram of the preferred embodiment of this invention.

Referring to FIG. 6, the voltage standing wave ratio (VSWR) diagram, FIG. 7, the return loss diagram, FIG. 8, the H plane radiation field diagram, and FIG. 9 the E plane radiation field diagram. The testing data reveal that the present invention satisfy the 50 Ω resistance value requirement under the 2.4 to 2.5 GHz channel band, and the radiation gain profit value could attain 6.5 dBi value.

As will be understood by persons skilled in the art, the foregoing preferred embodiment of the present invention is illustrative of the present invention rather than limiting the present invention. Having described the invention in connection with a preferred embodiment, modification will now suggest itself to those skilled in the art. Thus, the invention is not to be limited to this embodiment, but rather the invention is intended to cover various modifications and similar arrangements included within the spirit and scope of the appended claims, the scope of which should be accorded the broadest interpretation so as to encompass all such modification and similar structure.

While the preferred embodiment of the invention has been illustrated and described, it will be appreciated that various changes can be made therein without departing from the spirit and scope of the invention.

What is claimed is:

1. A collinear antenna structure comprising a dipole antenna, a coil, and at least a stacked radiators, wherein;

the length of said dipole antenna is ½ λ, the ground end and the signal end of said dipole antenna are connected to a coaxial cable;

the length of said coil is less than ¼ λ, wherein one end of said coil is axially connected in series to the top of said signal end of said dipole antenna;

the stacked radiators comprises at least two radiators positioned parallel to each other, wherein the length of said radiator is ½ λ, wherein one of the radiators is axially connected to the other end of said coil.

2. The collinear antenna structure claim 1, wherein the distance between the two radiators lies in the range of 1.0 mm to 4.0 mm.

* * * * *